United States Patent [19]

Quigley

[11] 4,109,370

[45] Aug. 29, 1978

[54] WIRE TERMINATING TOOL

[75] Inventor: James R. Quigley, Lombard, Ill.

[73] Assignee: TRW Inc., Elk Grove Village, Ill.

[21] Appl. No.: 807,364

[22] Filed: Jun. 17, 1977

Related U.S. Application Data

[62] Division of Ser. No. 656,580, Feb. 9, 1976, Pat. No. 4,047,294.

[51] Int. Cl.[2] ..... H01R 43/04

[52] U.S. Cl. ..... 29/566.3; 29/749

[58] Field of Search ..... 29/749, 751, 753, 760, 29/628, 566.3, 566.4

[56] References Cited

U.S. PATENT DOCUMENTS

| | | | |
|---|---|---|---|
| 3,845,535 | 11/1974 | Over | 29/749 |
| 3,953,916 | 5/1976 | Rolland et al. | 29/749 |
| 4,001,931 | 1/1977 | McKee | 29/749 |

*Primary Examiner*—Carl E. Hall

*Attorney, Agent, or Firm*—Neuman, Williams, Anderson & Olson

[57] ABSTRACT

A wire terminating tool is provided which simultaneously effects termination of a plurality of wires in a variety of connectors. The tool employs a nest adapted to receive connectors of a plurality of different constructions and to so position each connector that wire-receiving channels therein are in alignment with a plurality of tool stuffing or insertion blades. The latter simultaneously force a plurality of wires, initially aligned by a wire-aligning comb, into said channels. The wires are cut to desired length and are restrained from axially moving in the course of termination to obviate wire withdrawal from the channels during the terminating step. A novel handle pawl insures a desired, complete terminating stroke of the stuffing blades by the tool operator.

23 Claims, 21 Drawing Figures

10
12
14
16
18
21
22
22b
22c
22d
22e
22P
24
26
28
29
31
32
33
34
35
36
38
40
45
48
52
54
55
56
57
60
62
64
64F
66
71
72
73
74L
82
102
104
107
108
109
111
113
117
119
120
C

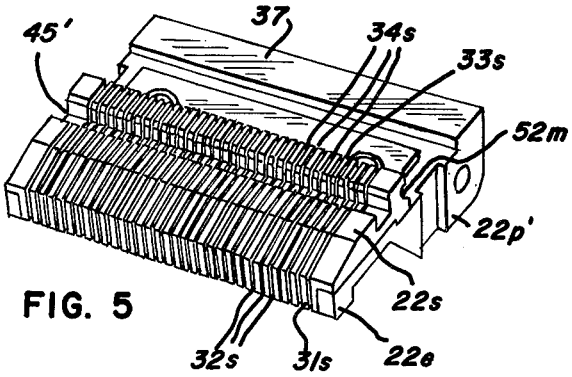
FIG. 5
FIG. 6
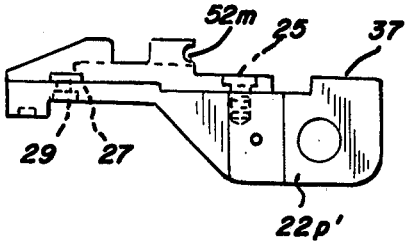
FIG. 7
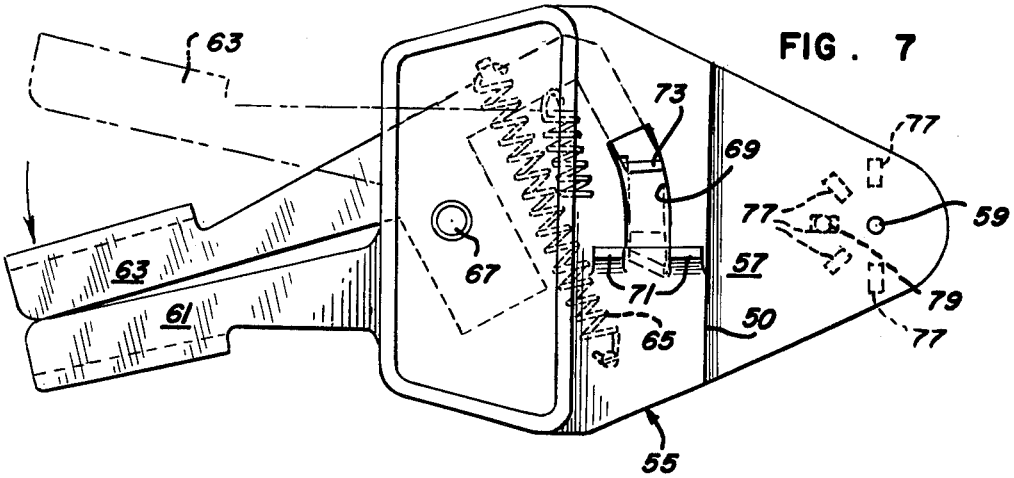
FIG. 8
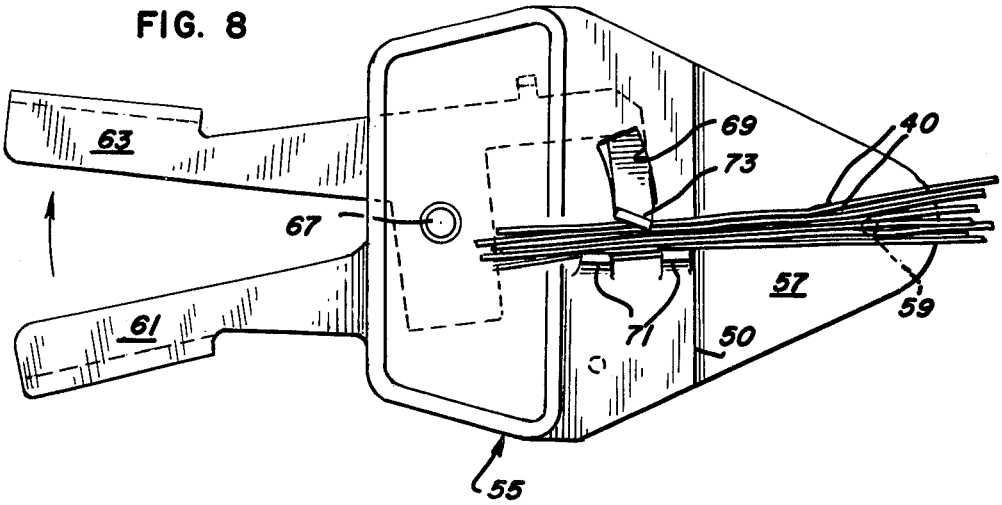

FIG. 19
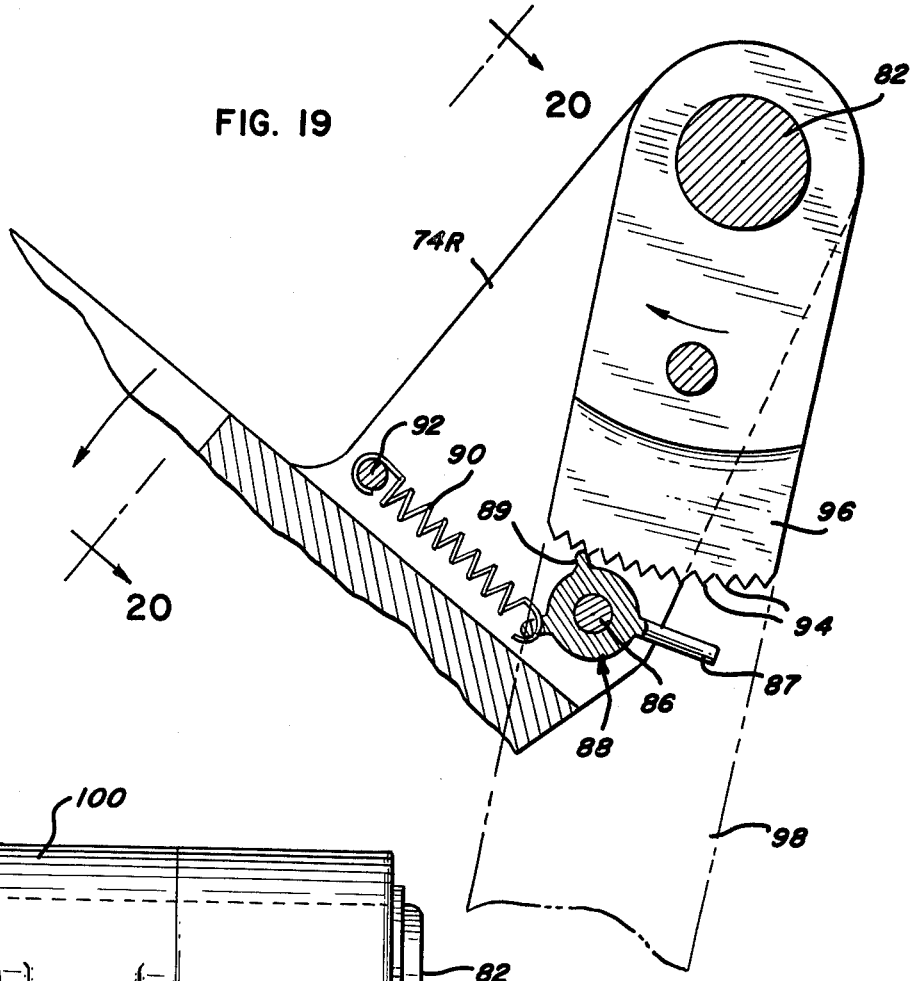
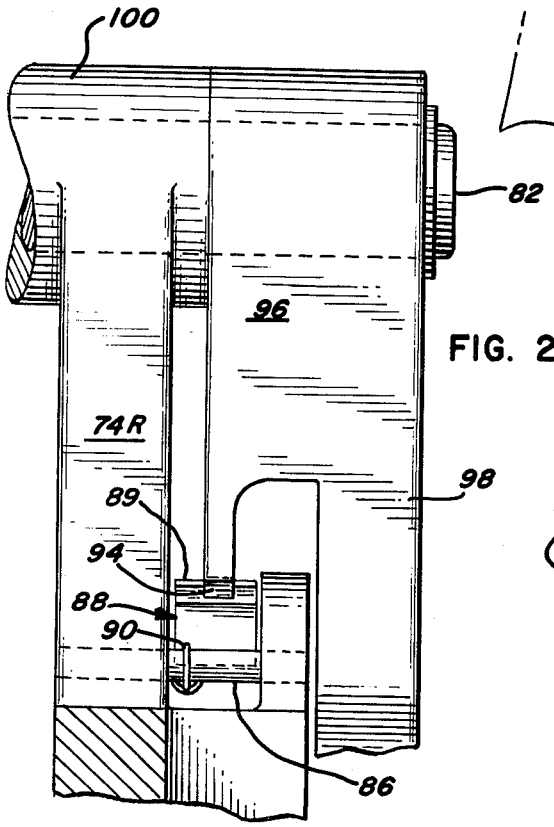
FIG. 20
FIG. 21
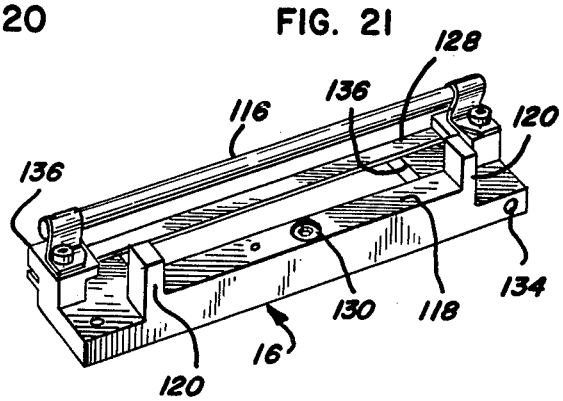

WIRE TERMINATING TOOL

This is a division of application Ser. No. 656,580 filed Feb. 9, 1976, now U.S. Pat. No. 4,047,294.

This invention relates to the formation of solderless wire terminations, and more particularly pertains to a portable apparatus which may be employed for effecting wire terminations in a plurality of multi-wire solderless connector constructions in an efficient and substantially error-free manner.

A variety of connector constructions of the type for use with the hereinafter discussed tool are disclosed in McKee U.S. Application Ser. No. 443,678 filed Feb. 19, 1974, and manufactured and sold by TRW, Inc. of Elk Grove Village, Ill. under the name CINCH RIBBON. Other ribbon connectors in commercial use which may be employed with the provided tool are manufactured by Bunker Ramo Corporation of Oak Brook, Ill. and by Amp, Inc. of Harrisburg, Pa.

There is a need for a portable terminating tool which may be easily carried onto the job site for purposes of effecting a plurality of solderless terminations in connectors of various constructions in a rapid efficient manner. Also, it is highly desirable to have safeguards against improper termination built into such a portable tool.

Accordingly, it is an object of this invention to provide a portable terminating apparatus which may efficiently effect solderless connections of a plurality of conductors in any of a number of multi-wire connectors of differing designs.

It is a further object of this invention to provide a novel handle ratchet and pawl arrangement which insures manual actuation of the provided tool through a full and complete stroke thereby assuring desired connector-conductor enagement.

It is yet another object of this invention to provide a terminating tool which although effecting multiple terminations simultaneously, requires the expenditure of a minimum of manual effort by virtue of the unique design features incorporated therein.

It is another object of this invention to provide a versatile tool which is light enough in weight for easy portability to a job site, and yet is rugged in details of construction so as to be suitable for assembly line use.

The above and other objects of this invention will become more apparent from the following detailed description when read in the light of the accompanying drawings and appended claims.

In one illustrative embodiment of the provided invention, a connector locating means or nest, adapted to engage multi-wire connectors of varied construction, is mounted on an apparatus base portion. Guide means adapted to locate wires to be terminated in a connector positioned in the nest are disposed in aligned, adjacent relationship with wire-receiving channels of such connector. A stuffing means comprising a plurality of spaced blades is then moved about a pivot axis by a manually actuatable driving handle whereby the wires are driven from the guide means into the connector channels and into locking conductive contact engagement with metal terminal portions therein.

Means mounted on the pivoting handle prevent upward movement thereof and of the driven stuffing means until the handle has reached the end limit of its pivotal movement and the stuffing blades have entered the connector channels to the optimum depth. Desired wire engagement with the connector terminals disposed within said channels is thus assured in the normal course of tool use. Shear portions of the stuffing blades in coaction with a novel multi-level shear blade trim the wires to desired length in the course of effecting the terminations, as will hereinafter be described in greater detail.

For a more complete understanding of this invention, reference will now be made to the drawings wherein:

FIG. 5 is a perspective view of a modified comb and cutting blade assembly which may be employed in an embodiment of the provided invention;

FIG. 6 is a side elevational view of the assembly of FIG. 5;

FIG. 7 is a top plan view of the clamping assembly employed in the tool illustrated in FIG. 1, illustrated on an enlarged scale, and depicting the movability of a clamping element thereof for clamping a cable or a group of wires.

FIG. 8 is a view similar to FIG. 7 illustrating the clamping assembly in engagement with a plurality of discrete wires;

FIG. 19 is a sectional view, partly in elevation, illustrating on an enlarged scale the structural elements of the illustrated device which insure a full and complete terminating step with each actuation of the handle;

FIG. 20 is an elevational view taken on line 20—20 of FIG. 19; and

FIG. 21 is a perspective view of a connector mount or nest which may be employed in the provided apparatus.

Figure 1:
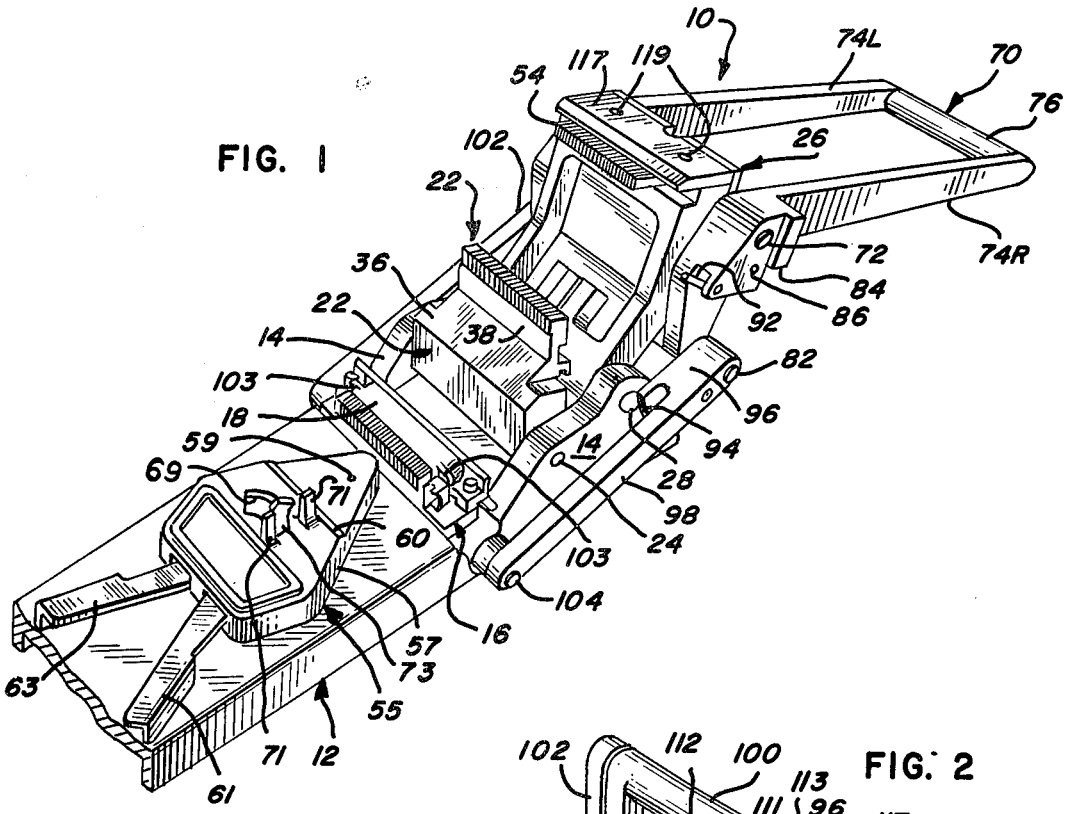
FIG. 1 is a fragmentary perspective view of one embodiment of a terminating apparatus made in accordance with the teachings of this invention, illustrated in the open, connector-receiving position.

Referring now to FIG. 1, a wire-terminating apparatus 10 made in accordance with this invention is illustrated having a base 12 which is preferably formed of cast aluminum or other light metal. The base is integrally formed with opposed side portions 14. A connector nest 16 is detachably secured to the base 12 by a screw 19 which engages tapped aperture 42 in base 12, as is most clearly seen in FIGS. 13–18. As is pointed out in the above objects of this invention, a number of different connector constructions may be employed with the tool of this invention. The connector mounting means or nest 16, in order to accommodate connectors of different construction, may be attached to base 12 in two positions, i.e., the position of FIGS. 13–15 in which connector 18 is accommodated, and the position of FIGS. 16–18 in which connector 20 may be mounted therein, as will hereinafter be more fully explained.

A comb and shear plate element 22 is pivotally mounted on a shaft 24 which is mounted at its opposite ends in side walls 14. A tool holder 26 is pivotally mounted on a shaft 28 which is in parallel spaced relation to shaft 24 and similarly mounted in sides 14.

The element 22 and holder 26 function to align and terminate individual wires 40 in the individual channel 30 of a connector mounted in the nest 16, as will be referred to further below.

The comb and shear plate element 22 may be of a unitary construction as in FIGS. 1–4 or, preferably, may be a multi-part assembly as in FIGS. 5 and 6 for economy and ease of manufacture and replacement of worn portions. Referring first to FIGS. 1–4, the element 22 includes a base portion 22*p*, two comb sections 22*b* and 22*c*, and a shear plate section 22*d*. Section 22*b* includes a series of upstanding spaced tines or plate portions 31 which define spaced channels 32 therebetween. Section 22*c* similarly comprises a series of upstanding spaced tines or plate portions 33 aligned with the tines 31 to define spaced channels 34 aligned with channels 32. The shear plate portion 22*d*, from which portions 31 extend, forms a sharp shear edge 35 at the outer end of the bottom of each channel 32.

Figures 3, 4:
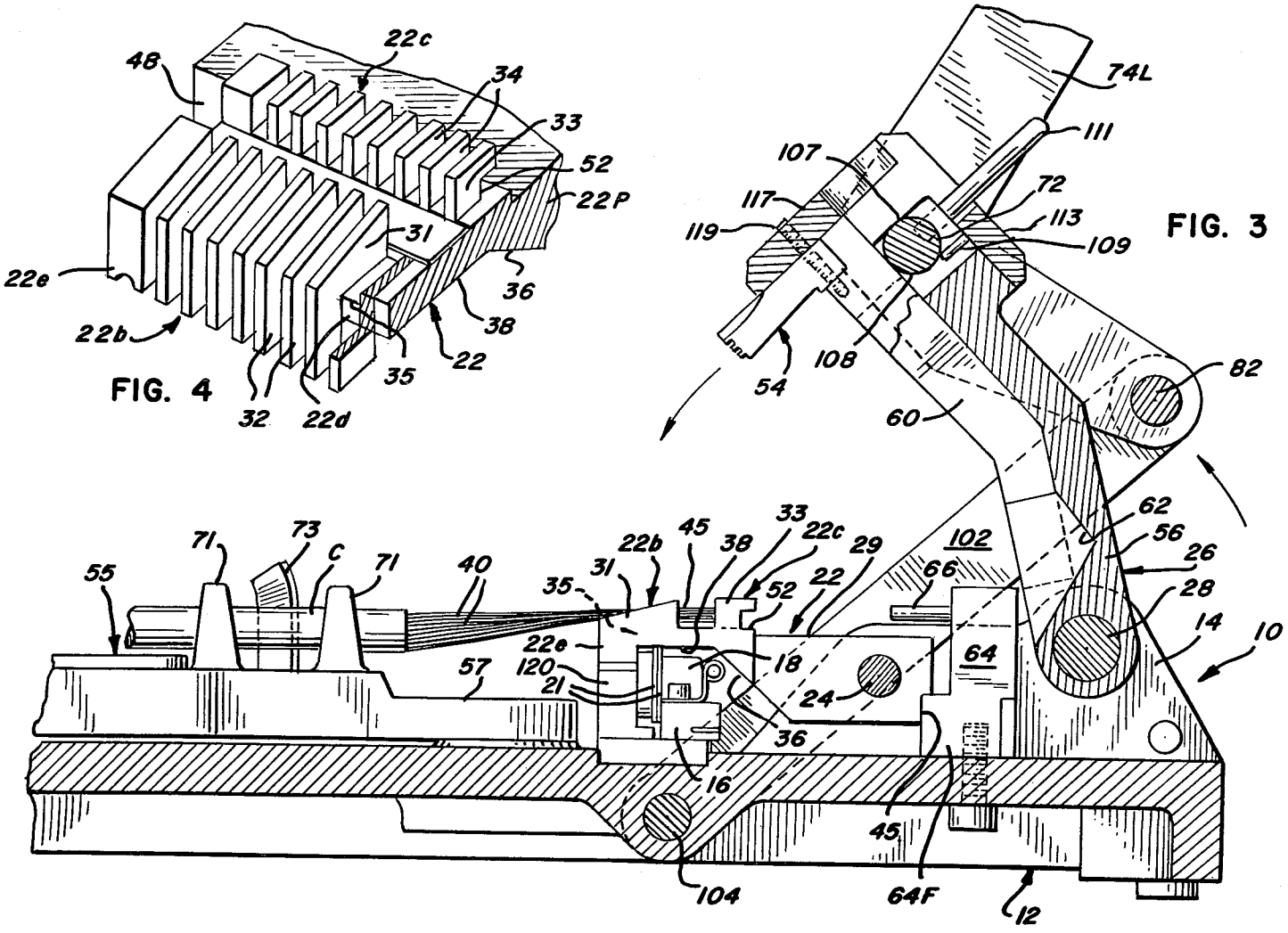
FIG. 3 is a fragmentary, longitudinal, sectional view of one embodiment of the provided tool, partly in elevation, illustrating the stuffing blades in the course of pivoting into terminating engagement with the underlying wires and connector.
FIG. 4 is an enlarged fragmentary perspective view of wire guide means which may be employed in the illustrated embodiment of the provided invention.

After a connector such as connector 18 is mounted in nest 16, as seen in FIG. 1, the element 22 is pivoted from the raised portion of FIG. 1 into the lower position of use as illustrated in FIG. 3. Thrust blocks 22*e* at the outer corners of the element 22 then rest on support posts 120 of the nest, see FIGS. 3, and 13–15, or the shoulders 136 when the nest is oriented as in FIGS. 16–18. With the pivotal guide and shear element 22 in the position of FIG. 3 and tool holder 26 in the fully open or retracted position of FIG. 1, individual wires 40 to be terminated in channels 30 of connector 18 are positioned over the connector in vertical alignment with the respective connector channels by means of being placed in the spaced guide channels 32 and 34 defined by tines 31 and 33 of the wire guide or comb 22.

As seen from FIGS. 3 and 4, tines 33 are undercut or notched at 52. The notches serve as a retaining device for maintaining wires 40 in a substantially taut condition after locating the wires in comb channels 32–34. To this end, each wire is bent at right angles and disposed along the notches 52 after being placed in the respective channels 32–34.

It will be noted from FIG. 3 that element 22 comprises a central section having a lower inclined surface 36 which defines a connector-receiving recess in combination with contiguous undersurface 38 of the comb section. It will be further noted from FIG. 3 that with the nest 16 in a position to accommodate connector 18, at the end limit of the pivotal movement of element 22, surface 38 is in close overlying relation or abuts flange portions 21 of connector 18 and thus assists in locking connector 18 in a fixed position in nest 16. By being arranged in alignment with the closely spaced comb and connector receiving tines and channels, a small amount of the wires to be terminated is consumed in bending, and wire consumption for terminating purposes is maintained at a minimum.

Although the comb and shear elements of plate 22 may be integrally formed in a single plate construction, as illustrated in FIGS. 1 and 3, such elements may be separably formed, as illustrated in FIGS. 5 and 6. In the latter figures, a separable comb 22*s* is detachably secured to a pivotally mounted plate 22*p*′ by screws 25 (see FIG. 6). Comb 22*s* may be formed of aluminum or other suitable material adapted to perform a wire-guiding function. Disposed beneath tines 31*s* of comb 22*s* is a shear blade 27 which extends across the plate 22*p*′ and may be secured to that plate by screws 29, see FIG. 6, to provide the shear edge at the bottom of each wire channel 32*s*. Since the shearing edges of blade 27 will eventually become worn in the normal course of use, a new blade may be readily substituted by removing comb 22*s* and old blade 27 from the plate 22*p*′, whereafter the new blade and comb are reassembled to the plate. The multi-component assembly of FIGS. 5 and 6 thus possesses the advantage of rapid shearing blade replacement and is less costly to maintain than the integral plate construction 22 of FIGS. 1 and 3. The multi-part construction of FIGS. 5 and 6 functions in precisely the same manner as the unitary plate 22. Arcuate tine notches 52′ in the embodiment of FIGS. 5 and 6 serve the same function as the notches 52 of FIG. 4.

The wires 40 typically are part of and individually extend from a cable C. A clamping assembly 55 is provided to position and hold the cable during termination of the wires. Thus, with plate 22 in the position of FIG. 3, the cable C may be clamped in place in the clamp assembly 55 which is illustrated in FIGS. 1, 2, 7 and 8. Assembly 55 comprises a plate 57 having a configuration resembling an arrowhead which is pivotally mounted on base 12 by means of pin 59. A shoulder 50 on clamp plate 57 (FIGS. 1, 7, 8) is adapted to serve as an index for locating the end of the cable sheath at a convenient distance from the connector 18. Thereafter, the discrete wires 40, each having its own color-coded identifying insulation covering, are located in the respective comb-locating channels 32–34 defined by tines 31 and 33 respectively.

Plate 57 has integrally formed therewith a hand grip 61 oppositely disposed to a pivotally mounted handle or grip 63 which is biased by spring 65 (see FIG. 7) to pivot about pin 67. An arcuate slot 69 is formed in the upper surface of plate 57. Spaced clamping fingers 71 are integrally formed with the upper surface of plate 57 at the slot end limit oppositely disposed hand grip 63. Defining one end limit of pivotal hand grip 63 is a clamping finger 73 which projects through and moves in slot 69. In the position of non-use, finger 73 is urged by spring 65 to a stop by position abutting the slot-defining edge interposed stationary clamping fingers 71, as is most clearly seen from FIG. 1 of the drawing. It will also be noted from FIG. 1 that the terminus portion of finger 73 is inclined toward the fingers 71 to effect a more effective gripping action in the manner as illustrated in FIG. 8.

When it is desired to clamp a cable in position, such as cable C in FIG. 3, hand grip 63 is urged against the biasing action of spring 65 from the phantom line position in FIG. 7 to the full line position, presenting a gap between the stationary clamping fingers 71 and the movable finger 73. A cable may be clamped in such gap upon release of the hand grip 63 in the manner illustrated in FIG. 3. However, the clamping fingers, by virtue of their tight wedging action, effect firm gripping and fixed positioning not only of a cable as in FIG. 3, but also fixedly position a plurality of individual wires such as wires 40 illustrated in FIG. 8.

It is oftentimes desirable to have an angular relation between the wires 40 and the connectors in which terminated other than the 90° disposition illustrated in FIG. 3. Accordingly assembly 55 may pivot about pin 59 and be positioned by means of indexing recesses 77 disposed on the undersurface of plate 57 (see FIG. 7) which engage a mating, spring loaded detent ball 79 disposed along the plate longitudinal axis on the upper surface of base 12. The clamping assembly may be positioned at a plurality of angular dispositions relative to the longitudinal axis of the tool base 12, e.g. or in the phantom line representation of clamping assembly 55 in FIG. 2, wherein the clamped cable axis is disposed at an angle of about 45° to the transversely-aligned channels 30 of connector 18.

After the cable has been located at the desired angle relative to the connector, the cable wires are strung into the comb channels 32–34 as previously noted. A terminating and wire-shearing stroke then is effected by means of stuffing blade assembly 54 mounted on the pivotal blade or tool holder 26, see FIGS. 1–3.

Tool holder 26 comprises a non-planar member having a proximal portion 56 pivotally mounted on the shaft 28 and a distal offset portion 60 on which blade assembly 54 is carried. A recess 62 is formed in the underside of portion 56 to receive a pivotal lock 64 as seen in FIG. 3. The lock comprises a block which is rotatable about a vertical axis and has a projecting foot **64*f* adapted to mate with a notch 45 formed in the rear edge surface of element 22 so as to lock the latter against pivotal movement. In the locked position of FIG. 3, element 22 is prevented from pivoting about shaft 24, and a finger 66 of the lock is aligned longitudinally of the base 12 to be received in the recess 62. In the non-locked position (rotated 90°), finger 66 of lock 64 will prevent downward movement of tool holder 26 into an operative position by striking a portion of the undersurface of proximal portion 56 adjacent recess 62. Thus, the tool 10 may only be operated with the combination comb and shear element 22 in a locked position of use. Also, when locked, element 22 assures proper mounting of a connector on the nest 16. In addition, pivotal movement of element 22 with a withdrawing blade assembly 54** is obviated following a terminating stroke thereof.

A bifurcated handle 70 pivotally engages the tool holder 26 by means of shaft 72 (see FIG. 1). Handle 70 comprises parallel bell crank levers 74R and 74L interconnected by hand grip 76 and fulcrumed on shaft 72. Each lever has a longer arm, engaging hand grip 76 at its distal end, and a shorter arm pivotally engaging a shaft 82 at its distal end (see FIGS. 1 and 2) and formed integrally with a stop block portion 84.

Referring to FIGS. 1, 19 and 20, a pin 86 is mounted in an enlarged proximal end portion of lever 74R, adjacent shaft 72. Pivotally mounted on the pin 86 is a pawl 88 (see FIG. 19). A tension spring 90 connected at one end to the pawl and at the opposite end to a pin 92 mounted in lever 74R urges the pawl 88 to rotate in a clockwise direction, as viewed in FIG. 19. Pawl 88 has a stop tooth 89 adapted to engage teeth 94 of ratchet portion 96 fixed on a pivot lever 98 which also pivotally engages shaft 82. The engagement of the pawl with the ratchet portion prevents clockwise rotation of the handle 70 relative to the lever 98, while effecting nonimpeding slipping engagement when handle 70 is rotated in a counterclockwise direction about shaft 82.

Figure 2:
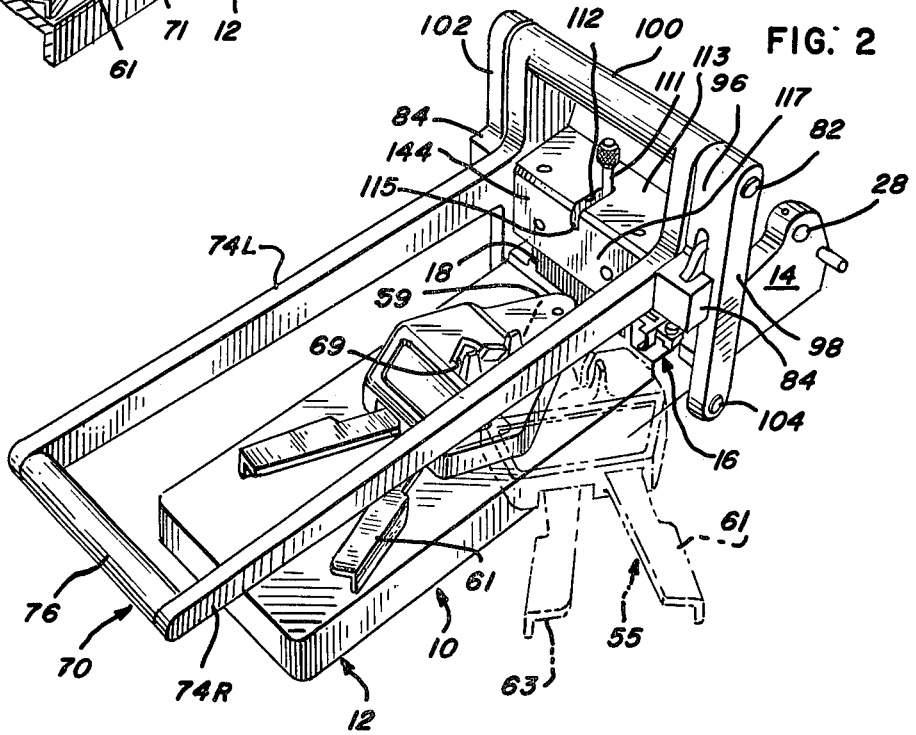
FIG. 2 is a view similar to FIG. 1 and illustrates the actuating handle at the end limit of a terminating stroke.

As seen from FIGS. 1, 2 and 20, the ratchet 96 is an integral portion of the elongate lever 98. Also, shaft 82 is mounted in a tubular housing 100. The housing 100 is integrally formed with and interconnects the proximal end portions of the handle bell crank levers 74R and 74L.

Both lever 98 and a corresponding lever 102 disposed on the opposite side (see FIG. 2) are pivotally mounted to the base 12 on a shaft 104. The shaft 104 is located beneath and substantially in vertical alignment with a connector in nest 16 in which wires are to be terminated. Since tool holder 26 is pivotally connected to handle 70 by means of shaft 72 (see FIG. 1), counterclockwise rotation of handle 70 will pivot holder 26 about shaft 28 in a counterclockwise direction, as viewed in FIGS. 1–3, until holder 26 comes to rest over the comb and the connector assembly, as illustrated in FIG. 2. In this position the stuffer blades 53 engage and drive the wires from the guide channels 32 into the connector channels 30. The handle 70 comes to an end limit of its pivotal movement when the stop blocks 84 integrally formed with each bell crank lever engage an edge portion of the opposed levers 98 and 102 as seen in FIG. 2.

It should be noted that in this final drive position of the handle 70, the linkage for driving the blades 53 is positioned with pivot shaft 82 over and in substantial vertical alignment with the shaft 104, such that link levers 98 and 102 are substantially vertical. This positions the links 98 and 102 substantially parallel to the direction of movement of the stuffer blades 53 during the trimming of the wires and driving of the wires into the contacts in the connector. As seen in FIG. 3, the displaced location of pivot shaft 28 and the configuration of holder 26 are such that the distal drive ends of the stuffer blades 53 move substantially normal to the connector channels during this trimming and driving movement. Further, during this final drive motion to seat the wires, in the connector, pivot shaft 72 is moving into alignment with links 98 and 102, over the connector. Thus, the opposed bell crank levers 74L and 74R of handle 70 define toggles with opposed levers 98 and 102, being pivotally interconnected at the "knee" shaft 82. These "toggles" are oriented substantially normal to the final drive motion of stuffer blade assembly 54 for maximum force amplification from the force applied by the operator on handle grip 76 to the seating force applied to the wires during trimming and particularly at final seating in the contacts within connector channels 30.

It will be noted from FIG. 19 that in the event it is necessary to move the handle 70 into the tool-opening or counterclockwise direction in the midst of a terminating stroke, the ratchet 88 may be manually pivoted by means of finger 87 counterclockwise to disengage the same from the ratchet teeth 94 and permit counterclockwise movement of the handle and tool carrier. In the normal course of usage, however, and without the deliberate disengagement of pawl 89, the manipulator of the apparatus 10 is compelled to effect a complete drive stroke of the drive linkage. This simultaneously drives stuffing blades 53 of assembly 54 through the comb guide channels 32 (FIG. 4) and thus simultaneously drives the wires to be terminated into the channels 30 of connector 18 (FIGS. 13–14), or into channels 41 of connector 20 (FIGS. 16–17), thereby shearing the wires to the desired length and positively driving the trimmed wires into fully seated electrical and mechanical engagement with the metal terminals in the connector. Since the handle 70 cannot be raised until the blades of the tool assembly 54 have fully penetrated into the connector, a terminating tool has been provided which eliminates incomplete wire terminations resulting from failure to fully drive the stuffers into the connector channels, as may be occasioned by failure of a tool operator to fully pivot the handle 70 to the end limit of its movement.

Figure 9:
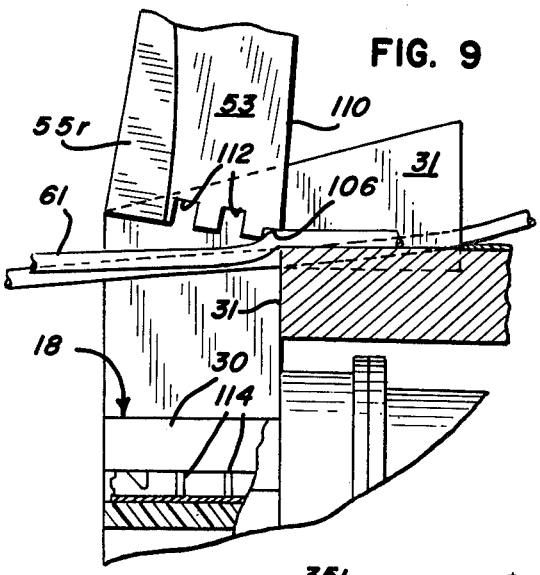
FIG. 9 is an enlarged fragmentary elevational view, partly in section, illustrating a stuffing blade just prior to effecting a wire shearing action with an underlying shear blade.
Figure 10:
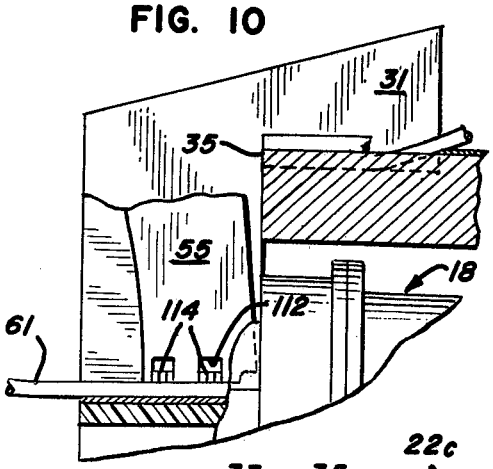
FIG. 10 is a view similar to FIG. 5 illustrating a stuffing blade at the end limit of its pivotal movement with the engaged wire in the terminated condition within a connector channel.

FIGS. 9 and 10 illustrate a stuffing blade 53 at the instant a wire 40 (comprising a metal conductor core and an insulation jacket) to be terminated is engaged by a rearmost notch-defining edge 106 of the blade. Edge 106 is illustrated in the course of driving the wire past shear edge 35 integrally formed with element 22, as the wire is disposed in a channel 32 defined in part by comb tines 31. The corner defined by edge 106 and rearmost blade shearing edge 110 serves to impale or hook the insulation material comprising the outer covering of the wire 40. This prevents any tension forces created in the wire in the course of stringing the same in the comb channels and locking the same under a desired tautness in tine notches 52 (FIG. 4) from axially withdrawing or pulling the wire from the connector channels toward the cable after severance and prior to final seating. Thus, the rear notches in the blades 53 prevent wire withdrawal from the connector during the step of termination, assuring electrical communication of the metal core of each wire 40 with the gripping jaws of the respective terminal in the manner described in the aforementioned McKee et al. U.S. application Ser. No. 443,678. Blade notches 112 allow full penetration of the blades 53 into the connectors without striking wire engaging jaws 114 at the connector channel bottoms, as illustrated in FIG. 10. Arcuate blade portion 53R is of reduced thickness and enables the blade to traverse strain relief jaws (not illustrated) disposed at the outer end of each wire-receiving channel 30.

Figure 11:
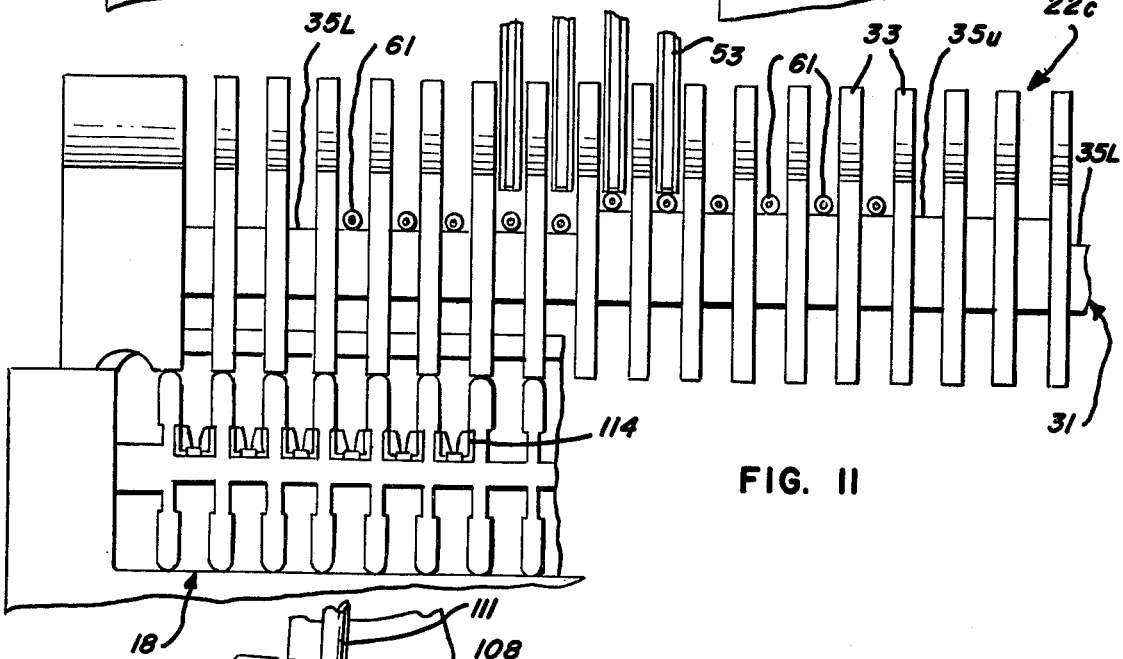
FIG. 11 is an enlarged fragmentary front view illustrating the multi-level nature of the shear blade employed in one embodiment of the illustrated apparatus.

FIG. 11 is illustrative of the novel two-level nature of shearing edge 35 of the integral comb and shear element 22. Since a force of approximately 30 pounds is needed to shear each wire, by arranging the upper surface of the cutting edge 35 at two different levels, as illustrated in FIG. 11, nine wires disposed above cutting edge surface 35U will be trimmed by the blades 53 before the eight wires disposed on either side are sheared at the lower blade levels 35L. Thus, a reduced force is required to cut the 25 wires since the same are sheared in two groups in sequence. As a modification, the cutting edges may be disposed on three or more levels. The blade 27 of the assembly of FIGS. 5 and 6 similarly has its shearing edge disposed on two levels for force-reducing purposes.

Since the illustrated connector 18 has 25 pairs of channels arranged on opposed sides, the overlying comb channels will also be 25 in number to correspond therewith. After 25 terminations are effected in the contacts of the 25 channels disposed on one side of connector 18, the latter is inverted for effecting terminations in the opposed side.

A color chart guide may be disposed on planar surface 29 (FIG. 3) of element 22 for disclosing to the tool manipulator the proper insertion sequence of the wires. When an opposed connector channel series is to have wires inserted therein, the chart may be inverted on the surface 29 for the second series order after the connector is inverted in the nest 16. Appropriate means may be disposed in surface 29 to releasably secure such chart in position. In the comb-plate combination of FIGS. 5–6, a color chart may be mounted on surface 37 of plate *p'*. Gap 48 between the tines 31, 33 of integral plate 22, and gap 45 between tines 31*s*, 33*s* of comb 22*s* (FIGS. 4, 5), enable the colors of the wire insulation to be readily seen for comparison with the adjacent chart for proper alignment purposes.

Figure 13:
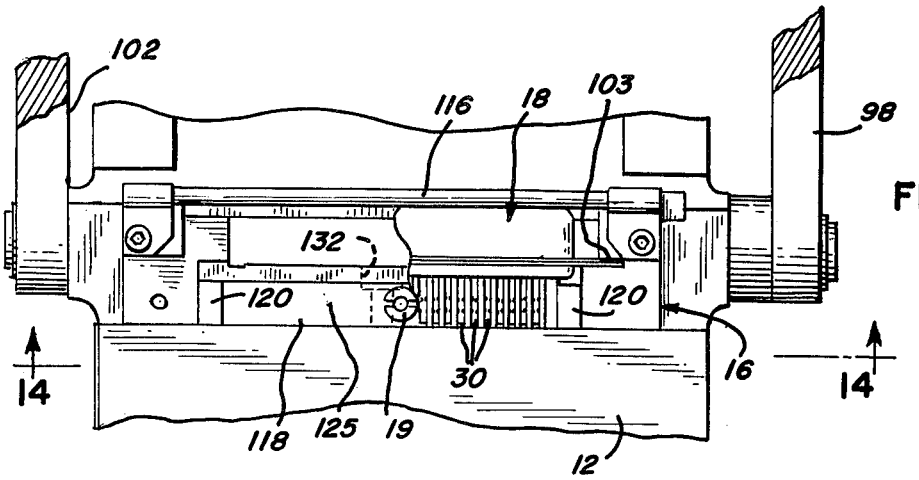
FIG. 13 is a partial top plan view showing a solderless connector currently manufactured by TRW Inc. in position on the mounting means or connector nest of the provided apparatus for termination of wires in the connector.
Figure 14:
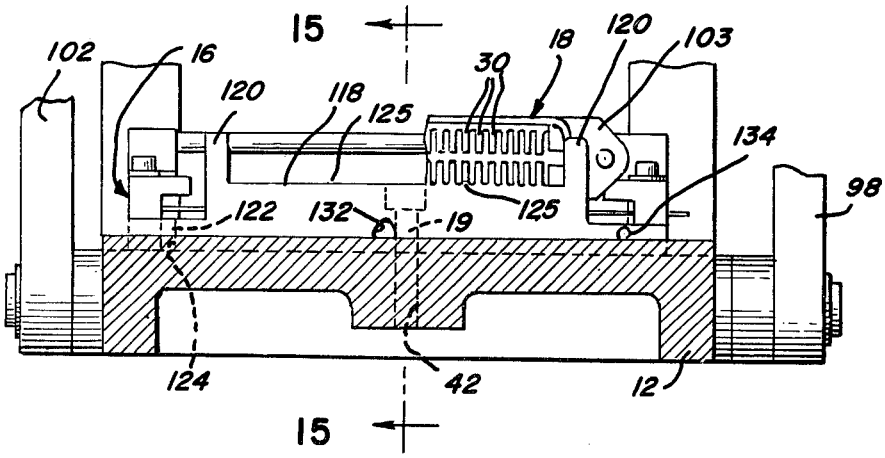
FIG. 14 is a fragmentary sectional view partly in elevation taken on line 14—14 of FIG. 13.
Figure 15:
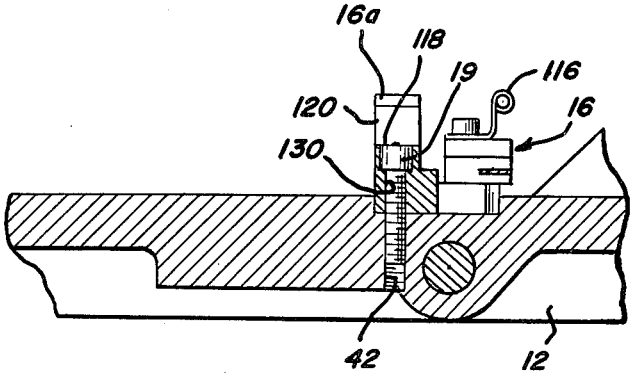
FIG. 15 is a fragmentary sectional view partly in elevation taken on line 15—15 of FIG. 14.

The nest 16, as illustrated in FIGS. 13 through 15, is supporting connector 18. A perspective view of nest 16 is illustrated in FIG. 21. The top plan view of FIG. 13 illustrates the manner whereby the connector 18 is received between the resiliently mounted rod 116 (see FIG. 15) and an opposed nest cradle portion. The cradle portion comprises support surface 118 which supportingly engages the plastic, channel-defining portion of the connector and prevents axial movement of the connector in the horizontal plane by means of opposed posts 120 which snugly receive the length of the connector plastic channels therebetween (FIG. 14). Attachment portions or "ears" 103 of the connector 18 extend behind posts 120. Connector 20 has attachment portions 105. As previously noted, positioning and locking of the connector 18 within the tool nest is assisted by the closure thereover of the guide and shear element 22 prior to the terminating stroke of the tool assembly 54. The connector support and the drive linkage for the tool holder 26 preferably are so related that for a connector 18 a full terminating stroke drives the blades 53 to a point where their lower ends are spaced from the bottom walls of the terminals 114 a distance less than the outside diameter of the insulated wires 40 to insure proper seating of the wires in those terminals. The wires thus are forcefully compressed against the bottom wall of the contact channels to insure proper engagement of the conductor core with the contact jaws 114.

In addition to the securing screw 19 illustrated in FIGS. 13–15, the nest 16 is located in base 12 with the assistance of a locating pin 122 (see FIG. 14) mounted on base 12 which interfits with a locating aperture 124 disposed at the bottom of nest 16.

Figure 16:
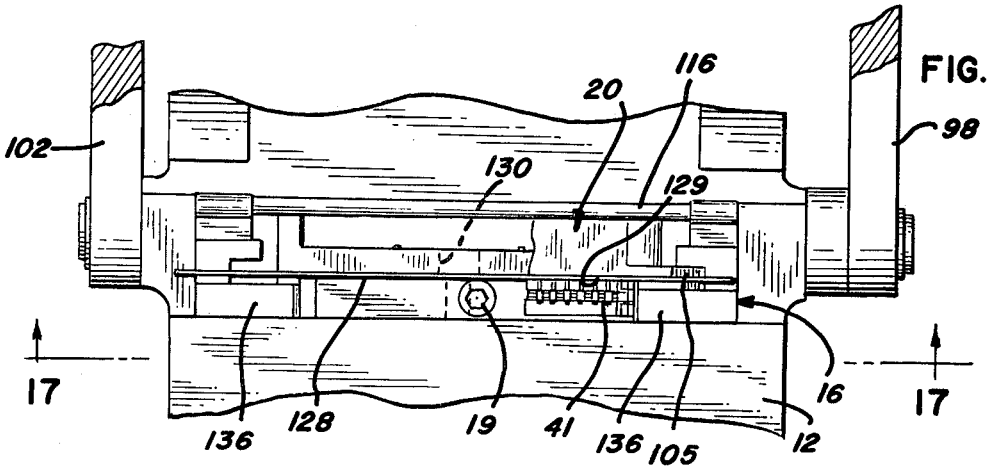
FIG. 16 is a view similar to FIG. 13 illustrating the nest of FIG. 13 in an inverted position with a connector of another design, such as that manufactured by Amp, Inc., mounted thereon for wire termination.
Figure 17:
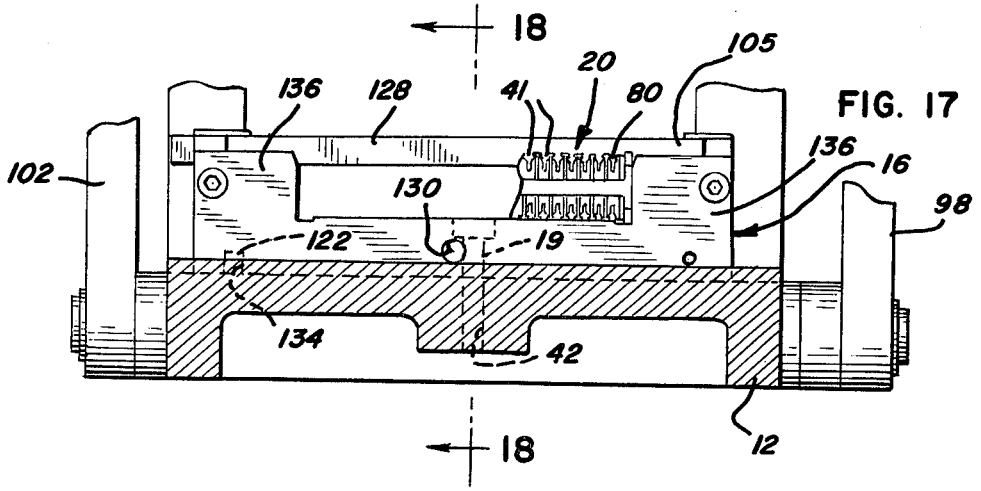
FIG. 17 is a fragmentary sectional view partly in elevation taken on line 17—17 of FIG. 16.
Figure 18:
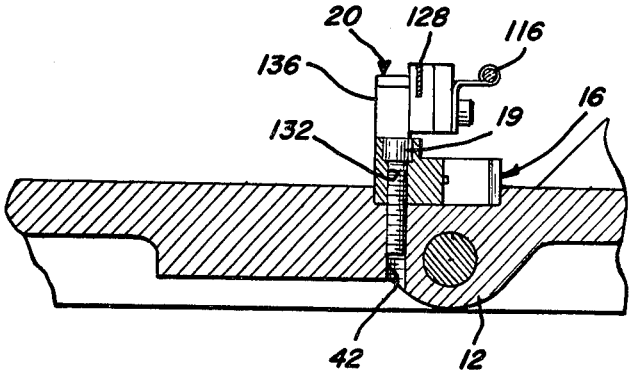
FIG. 18 is a sectional view partly in elevation taken on line 18—18 of FIG. 17.

By rotating the nest 90° in the horizontal plane and turning the same end for end, or 180° in the vertical plane, the nest 16 (after disengagement of screw 19) may be repositioned on the base 12 in the manner illustrated in FIGS. 16 through 18 to supportingly accommodate a connector 20 of another design, such as the connector sold by Amp, Inc. under the name "AMP CHAMP." In view of the shorter wire-receiving channels of the connector 20, a pivoting blade 128 is employed to guide the trimmed wires into the connector and into engagement with the wire-gripping terminals thereof. Blade 128 thus prevents the distal ends of the trimmed wires from hanging up and being curled by edge 129 of connector 20 (see FIG. 16). It will be noted that screw 19 anchors the nest 16 in the same base aperture 42, as was used in connection with the nest position of FIGS. 13–15. The nest aperture 130 traversed by screw 19 in FIGS. 13–15 is seen in FIGS. 16–18, and the nest aperture 132 traversed by screw 19 in FIGS. 16–18 is shown in FIGS. 13 and 14. Also, a second locating aperture 134 in nest 16 engages the locating pin 122 when the nest is in the position of FIGS. 16–18, as seen in FIG. 17.

Figure 12:
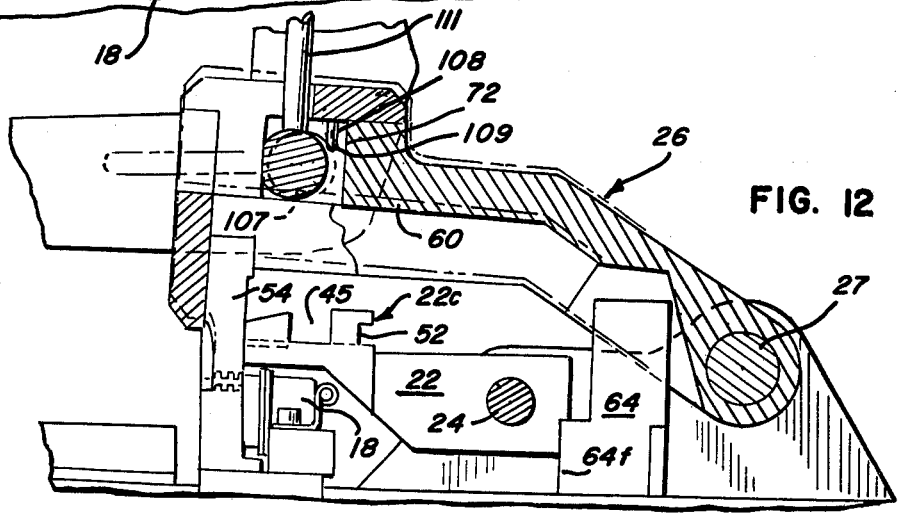
FIG. 12 is a fragmentary longitudinal sectional view of the tool carrier and connector mount employed in one embodiment of the provided invention.

Opposed faces of connector 20 are thus snugly locked between blade 128 and resiliently mounted rod 116, and the opposed ends of the termination section of the connector 20 are received between opposed nest shoulders 136, as seen in FIG. 17 wherein only one end of the fragmentarily illustrated connector is shown in engagement with a shoulder. For a connector 20, the stuffer blades 53 preferably are not driven to a depth to force the wires against the lower edges of the terminal slots.

Where it is necessary to have the blade assembly 54 project from the tool holder 26 different distances as may be necessitated, for instance, by connectors of different designs and by male and female connectors having wire-receiving channels of different depths, shaft 72 which engages opposed lever portions of the handle 70 may have one or more flat peripheral surface portions 107 (see FIGS. 3, 12) enabling it to serve as a cam. The shaft is disposed in shaft-receiving channel or opening 108 disposed in the tool-engaging portion 60 of tool carrier 26. A biasing spring member 109 maintains shaft 72 in a stable non-rotating condition within transverse channel 108 in the normal course of tool carrier pivotal movement. When shaft 72 is rotated 90° from the full line position of FIGS. 3 and 12 to the position shown in phantom in FIG. 12, by manipulating an attached finger-actuatable lever 111 in a counterclockwise direction seen in FIG. 3, the flat 107 will be disposed lowermost in the opening 108 parallel to the lower surface of the tool carrier section in which mounted. Actuating shaft 72 and finger 111 are able to so pivot by virtue of slot 112 (see FIG. 2) formed in cover plate 113 and slot 115 formed in front plate 117 (see FIG. 2). This adjustment, of course, is made with the tool holder 26 retracted. Securing means such as screws 119 may traverse front plate 117 and anchor the tool assembly 54 in portion 60 of the tool carrier 26 (see FIG. 3).

Upon application of a terminating force by the handle 70, that force is applied directly to the shaft 72 by handle 70, and thence to the holder 26 by the shaft 72. With the flat 107 opposite the lower wall, the stuffer blade assembly 54 is not driven as deeply as when the full round diameter portion of the shaft is opposite that wall, i.e., compare the phantom positions of FIG. 12 with the full line positions. Thus, with the apparatus in the position of FIG. 2, the tool assembly 54 is forced to extend into the channels of the underlying connector mounted in the apparatus nest an additional linear increment comprising the radial length of the portion of shaft 72 which was removed to form flat 107. Movement of the shaft 72 in recess 108 is followed by the biasing spring 109 to allow for a smooth rattle-free shaft movement.

Although the drawings illustrate two specific connectors having opposed series of channels adapted to terminate 25 wires each, the flexibility of the provided apparatus enables the same to efficiently terminate wires in connectors having opposed pairs of channel series which are seven, 12 or 18 in number. Nest locating pins 125 assist in centrally locating connectors 18 of lesser channel numbers on the nest support surface 118. Such connectors are known in the art and are readily adaptable for use with the above-described apparatus. Connectors having series of 32 channels in opposed pairs may also be employed with the above-described apparatus after the tool assembly 54 and comb and nest units are changed to accommodate the larger number of channels. Such connectors may be employed in control office wiring installations. The structure of the changed elements will be precisely as described above with the exception that the size is increased to accommodate the larger connectors.

The provided terminating tool has thus been seen to accommodate a variety of connectors originating with different manufacturers. The drive system assures ease of trimming and positive complete seating of the wires. The novel handle construction provided necessitates a complete terminating stroke of the stuffing blade assembly before the same may be raised, thus assuring complete wire terminations with the terminal jaws within the connector wire-receiving channels. Also, the novel wire-shearing elements provided, and specifically the novel notched structure of the stuffing blades, assure proper location of the terminated wires to the desired depth within the connector channels without withdrawal therefrom occasioned by wire tension. Thus, electrical contact with all terminals of the connector is assured.

Many variations in structure within the spirit of the invention disclosed will become apparent from the foregoing detailed description. This invention is to be limited, therefore, only by the scope of the appended claims.

What is claimed is:

1. In an apparatus for effecting solderless termination of a plurality of wires in a connector of the type having a plurality of channel-shaped recesses, each of said recesses having a wire-engaging terminal disposed therein, the combination comprising first means for supporting a plurality of wires in predetermined, spaced relationship; means for supporting such connector in a position relative to such supported wires whereby each of said wires is disposed in adjacent relationship opposite a channel-shaped recess of said connector; stuffing means for engaging all of said supported wires and for driving the same into said connector recesses into engagement with the terminals therein; said first means including a plurality of wire-guiding channels disposed in alignment above said connector channels in the normal position of apparatus operation; said first means also including a wire shearing edge disposed adjacent the distal ends of said connector channels in substantially the same plane therewith when such connector is located in the supporting means; the wire engaging means having shear edge portions which cooperate with said shearing edge whereby said wires are sheared substantially flush with the connector channel distal edges in the course of being driven into engagement with said connector terminals; said shearing edge having a configuration for effecting a shearing relation with said shear edge portions of said wire-engaging means whereby such wires are not sheared simultaneously.

2. The apparatus of claim 1 in which said stuffing means comprises a plurality of spaced blades movable as a unit into said connector channels; each of said blades being notched at the lower end of its shearing edge whereby an adjacent notch-defining corner spaced from said shearing edge impales the wire insulation prior to a shearing of such wire by the blade shearing edge.

3. The apparatus of claim 1 in which said connector supporting means is supported on a base portion of said apparatus, and is in combination with means for securing said connector supporting means to said base portion in a plurality of different positions relative to said base portion; said supporting means being adapted to support connectors of different constructions in said different positions for engagement with said stuffing means.

4. The apparatus of claim 2 in which each of the stuffing blades is notched along the lower leading edge thereof which first enters said connector channels; said notches being arranged so as to receive said wire-engaging terminals therein when fully entered into said connector recesses.

5. The apparatus of claim 1 in which said shearing edge is formed integrally with the wire guiding channels and comprises an edge located intermediate the ends of said wire guiding channels, whereby wires driven through said guiding channels are sheared in the course of being driven therethrough by said stuffing means coacting with said shearing edge.

6. The apparatus of claim 1 in which each of said wire insulation coverings has a distinctive color and the wire guiding channels comprise channel-defining tines which have uniform aligned gaps interposed the lengths thereof whereby the color of the wires disposed in said guiding channels may be readily seen in said gaps; said wire guiding channels being detachably connected in overlying, adjacent relation with said shearing edge.

7. The apparatus of claim 6 in which said wire guiding channels are fabricated of aluminum and said cutting edge is fabricated of cutting steel; said shearing edge being detachably connected to a base portion of said apparatus on which mounted beneath said wire guiding channels.

8. The apparatus of claim 1 in combination with a clamping means mounted on a base portion of said apparatus; said clamping means comprising a plate member having at least one fixed, clamping finger extending from the surface thereof; said plate having a slot in said plate terminating adjacent said projecting finger, a movable projecting finger movable in said slot, and means connected to said movable finger resiliently biasing said movable finger in said slot toward said fixed finger.

9. The apparatus of claim 8 in which said plate member is pivotally mounted on said apparatus base and has indexing means disposed on the undersurface thereof for locating said plate member at predetermined angles relative to the apparatus longitudinal axis.

10. The apparatus of claim 8 in which two fixed fingers are disposed at the end limit of said slot, and said movable finger is received therebetween at the end limit of said movable finger movement in said slot.

11. The apparatus of claim 8 in which a first hand grip is integrally formed with said plate and said movable finger is connected to a second hand grip adjacent said first hand grip and located to permit ready actuation of the movable finger in said slot by the fingers of one hand.

12. In an apparatus for effecting solderless termination of a plurality of wires having insulation coverings into a connector of the type having a plurality of channel-shaped recesses, each of said recesses having a wire-engaging terminal disposed therein; the combination comprising means for supporting such connector; stuffing means for stuffing such wires into such connector recesses when such connector is mounted on the supporting means; said stuffing means being movable from a first position through a fixed path into inter-fitting engagement with such connector channels; means for locating such wires in the path of said stuffing means and guiding the wires after engagement with the stuffing means into the connector channels, a shearing edge having portions thereof arranged in different planes disposed in the said stuffing means path for trimming such wires to predetermined length in said different planes in the course of being driven into the connector recesses; said stuffing means having corner portions impaling the wire insulation in the course of shearing such wires and maintaining such impaling engagement with such wires until terminations are effected with the wire-engaging terminals of such connector.

13. Apparatus of claim 12 in combination with wire clamping means, pivotally adjustable platform means disposed adjacent the connector supporting means for supportably mounting said wire clamping means, and means for positioning wires in clamped condition on said clamping means at predetermined angles relative to the axes of said connector channels by positioning said platform until the wire clamping means thereon is at a predetermined angle adapted to effect the predetermined angles of such wires.

14. In an apparatus for effecting solderless termination of a plurality of wires having insulation coverings in a connector of the type having a plurality of channel-shaped recesses, each of said recesses having a wire-engaging terminal disposed therein, the combination comprising first means for supporting first portions of a plurality of wires in spaced relationship; wire clamping means mounted on a movable support for clampingly engaging second portions of such plurality of wires; means for supporting such connector relative to such supported first wire portions whereby each of the latter wire portions is disposed in adjacent relationship opposite a channel-shaped recess of said connector; terminating means for engaging all of such supported wire portions and for driving the same from said supporting means into said connector recesses and into engagement with the terminals therein in the course of a terminating stroke; wire-shearing edge means disposed adjacent the distal ends of said connector channels in substantially the same plane therewith when such connector is located in the supporting means; the terminating wire engaging means having shear edge portions which cooperate with said shearing edge whereby said wires are sheared substantially flush with the connector channel distal edges in the course of being driven into engagement with said connector terminals; said shearing edge having a configuration for effecting a shearing relation with said shear edge portions of said wire-engaging means whereby such wires are not sheared simultaneously; each of said shear edge portions being notched at the lower end of its shearing edge whereby an adjacent notch-defining corner spaced from said shearing edge impales the wire insulation prior to a shearing of such wire by the blade shearing edge.

15. The apparatus of claim 14 in which said terminating means is driven through its terminating stroke by a toggle linkage, one link of said toggle having a ratchet disposed thereon; a pawl in engagement with said ratchet mounted on another link of said toggle which permits movement of the terminating means and of the linkage on which the ratchet is mounted only in the direction of completing said terminating stroke until said termination stroke is completed in the normal course of apparatus operation.

16. The apparatus of claim 15 in which said pawl is resiliently biased into engagement with said ratchet by biasing means mounted on said another link and engaging said pawl, and a manually engageable portion on said pawl for releasing the same from engagement with said ratchet against the action of said biasing means.

17. The apparatus of claim 15 in which said link on which said pawl is mounted comprises a bell crank lever; a carrier for said terminating means; said bell crank lever being pivotally mounted to said carrier and defining a handle for actuating said tool through its terminating stroke.

18. The apparatus of claim 17 in which said first lever and said link of said toggle are disposed substantially normal to said connector channels as they approach said mutual alignment position during the driving of said wires by said blades into said connector channels.

19. The apparatus of claim 17 in which said handle is pivotally mounted on a shaft located in the terminating means transversely to the path of said terminating means terminating stroke; said shaft actuating said terminating means at the end of said terminating stroke; said shaft having a cam surface enabling said terminating means to transverse a terminating stroke of one length when in an inoperative position which length is different from the length of the terminating stroke when said cam surface is in an operative position; and exteriorly accessible cam regulating means connected to said shaft for moving the shaft cam surface into operative and inoperative positions.

20. The apparatus of claim 16 in which said handle traverses a fixed arcuate path in the course of moving said terminating means through a terminating stroke; the end limit of said arcuate path being effected by abutment of said handle against said link; said terminating means carrier and terminating means pivotally mounted on said shaft effecting an arcuate path dependent upon the position of said shaft cam surface.

21. The apparatus of claim 15 in which said linkage includes a first lever pivotally connected to said terminating means at the fulcrum of said first lever; a link pivotally mounted on a base portion of said apparatus at one end and pivotally engaging a proximal end of said first lever at the opposed end; a distal end portion of said first lever comprising a handle whereby said pivoting link and said first lever are simultaneously pivoted by actuation of said handle in one direction of pivotal movement and into substantial alignment with one another; said terminating means being moved by said first lever into overlying relation with said connector and thereafter being driven for urging wires into said connector channels by the toggle action of said first lever and said link as they approach said alignment position.

22. The apparatus of claim 21 in which said terminating means is pivotally mounted on said apparatus base portion.

23. In an apparatus for effecting solderless termination of a plurality of wires in a connector having oppositely disposed series of open-sided wire-receiving channels, each of said channels having wire-gripping means disposed therein, the combination comprising a base having a connector-mounting nest mounted thereon; said nest being constructed to supportingly receive said connector with one series of channels disposed upwardly in substantially the horizontal plane in the normal position of apparatus use; means movable into overlying relation with said one series of channels and including spaced wire guides defining guide passages for movement therethrough of wires to be terminated in said connector channels; said guide passages being in aligned superposed relation with said connector channels when moved into said overlying relation and including upwardly open portions for receiving said wires; stuffing blade means mounted on said apparatus and movable through a terminating stroke; said wire guides and connector channels being on the path of said stuffing blades in the course of said terminating stroke whereby said stuffing blades drive wires so disposed in said guide passages through said guide passages into said connector channels and into engagement with said wire gripping means; said movable means including a cutting edge disposed in the path of the wires being driven through said wire guides and disposed in shearing relation with the stuffing blades in the course of movement thereof past said edge, whereby wires disposed in said wire guides are sheared to desired length by said edge prior to being driven into said connector channels for termination therein; said shearing edge being disposed on a plurality of levels whereby said wires are sheared in discrete series in the course of being driven through the wire guides and the required shearing force is less than that required if all wires are sheared simultaneously.

* * * * *